US005956779A

United States Patent [19]

Chung

[11] Patent Number: 5,956,779

[45] Date of Patent: Sep. 28, 1999

[54] HYDRAULIC DRIVE URINAL FLUSHING SYSTEM

[76] Inventor: Ching-Wei Chung, No. 15, Lane 433, Chung Hsing Rd., Lun Shang Village, Chuang Chin Shiang, Pin Tung Hsien, Taiwan

[21] Appl. No.: 09/064,102

[22] Filed: Apr. 22, 1998

[30] Foreign Application Priority Data

May 2, 1997 [TW] Taiwan ..... 86207059

[51] Int. Cl.[6] ..... E03D 5/08; E03D 13/00

[52] U.S. Cl. ..... 4/302; 4/249; 4/308; 4/313; 4/345; 251/57; 251/295

[58] Field of Search ..... 4/302, 313, 308, 4/345, 367, 407, 249; 251/295, 57

[56] References Cited

U.S. PATENT DOCUMENTS 533,021 1/1895 Scott ..... 4/308 X
916,758 3/1909 Murphy ..... 4/249 X
1,083,382 1/1914 Wenker et al. ..... 4/249 X
3,594,829 7/1971 Seek ..... 251/295
4,052,035 10/1977 Kenny et al. ..... 251/57 X

*Primary Examiner*—Henry J. Recla
*Assistant Examiner*—Kathleen J. Prunner
*Attorney, Agent, or Firm*—Bacon & Thomas PLLC

[57] ABSTRACT

A hydraulic drive urinal flushing system includes a hydraulic cylinder having a piston reciprocated therein and a piston rod upwardly extended from the piston, a weight sensor mounted on the piston rod outside the hydraulic cylinder, and a valve connected to the hydraulic cylinder by a pipe for controlling the supply of flushing water to a urinal, the hydraulic fluid being forced out of the hydraulic cylinder into the valve to open the valve for letting flushing water pass to the urinal when the user steps on the weight sensor, the hydraulic fluid being returned from the valve to the hydraulic cylinder when the piston is moved downwards from the elevation of the pipe, the hydraulic fluid being forced out of the hydraulic cylinder into the valve to open the valve for letting flushing water pass to the urinal again when the user leaves from the weight sensor.

3 Claims, 3 Drawing Sheets

HYDRAULIC DRIVE URINAL FLUSHING SYSTEM

BACKGROUND OF THE INVENTION

The present invention relates to a hydraulic drive urinal flushing system, and more particularly to such a urinal flushing system which flushes the urinal before and after each use.

As shown in FIG. 1, a regular urinal flushing system is generally comprised of a water outlet pipe connected to the urinal at the top for guiding flushing water from a water source to the urinal, a valve mounted in the water outlet pipe, and an infrared sensor connected to the valve for controlling its operation. This structure of urinal flushing system has drawbacks. Because the infrared sensor is operated with electricity, it does not function when power fails. When the infrared sensor does not function, the flushing system becomes unworkable. Further, because the infrared sensor is sensitive, it will be triggered when a person passes through its detective range, causing the flushing system to process to the next step. Frequently triggering the infrared sensor falsely wastes much water, and shortens the service life of the infrared sensor.

SUMMARY OF THE INVENTION

The present invention has been accomplished to provide a hydraulic drive urinal flushing system which eliminates the aforesaid drawbacks. According to the present invention, when the user steps on a weight sensor, the weight sensor is lowered to compress a spring member, and a piston is lowered with the weight sensor and a piston rod to force the hydraulic fluid out of a hydraulic cylinder through a hydraulic cylinder delivery pipe into a valve, thereby causing the valve body of the valve to be opened, enabling water to pass to the urinal. The hydraulic fluid is returned from the valve through the hydraulic fluid delivery pipe to the hydraulic cylinder when the piston is lowered in the hydraulic cylinder below the elevation of the hydraulic fluid delivery pipe. The weight sensor is pushed upwards by the spring member to lift the piston in the hydraulic cylinder when the user steps off of the weight sensor, thereby causing the hydraulic fluid to be forced out of the hydraulic cylinder through the hydraulic fluid delivery pipe into the valve, and therefore the valve body of the valve is opened again to let water pass to the urinal.

DETAILED DESCRIPTION OF THE PREFERRED EMBODIMENT

Figure 2:
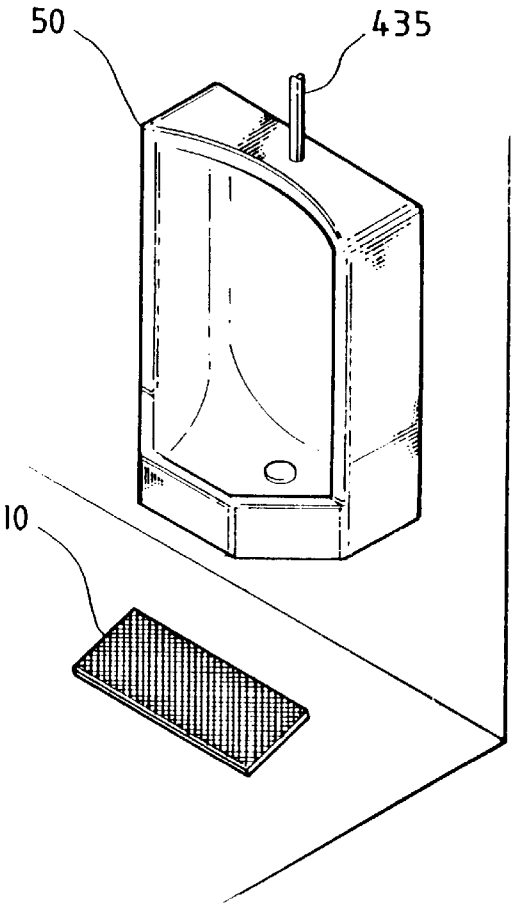
FIG. 2 is a perspective view of a hydraulic drive urinal flushing system according to the present invention.
Figure 1:
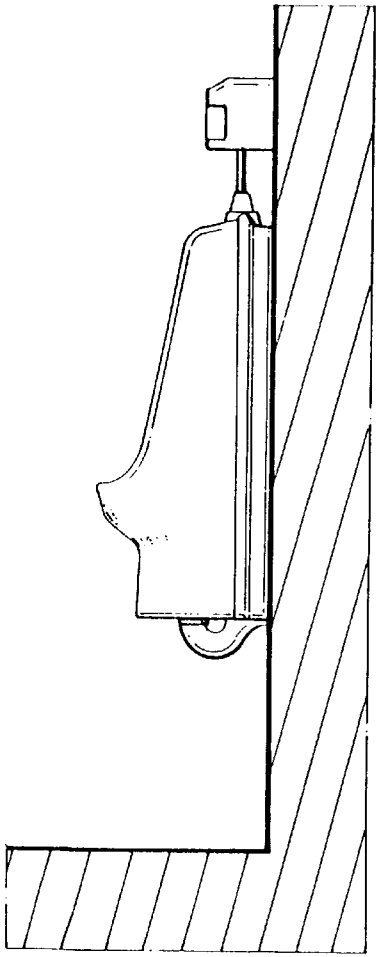
FiG 1 PRIOR ART
FIG. 1 shows a urinal flushing system according to the prior art.
Figure 3:
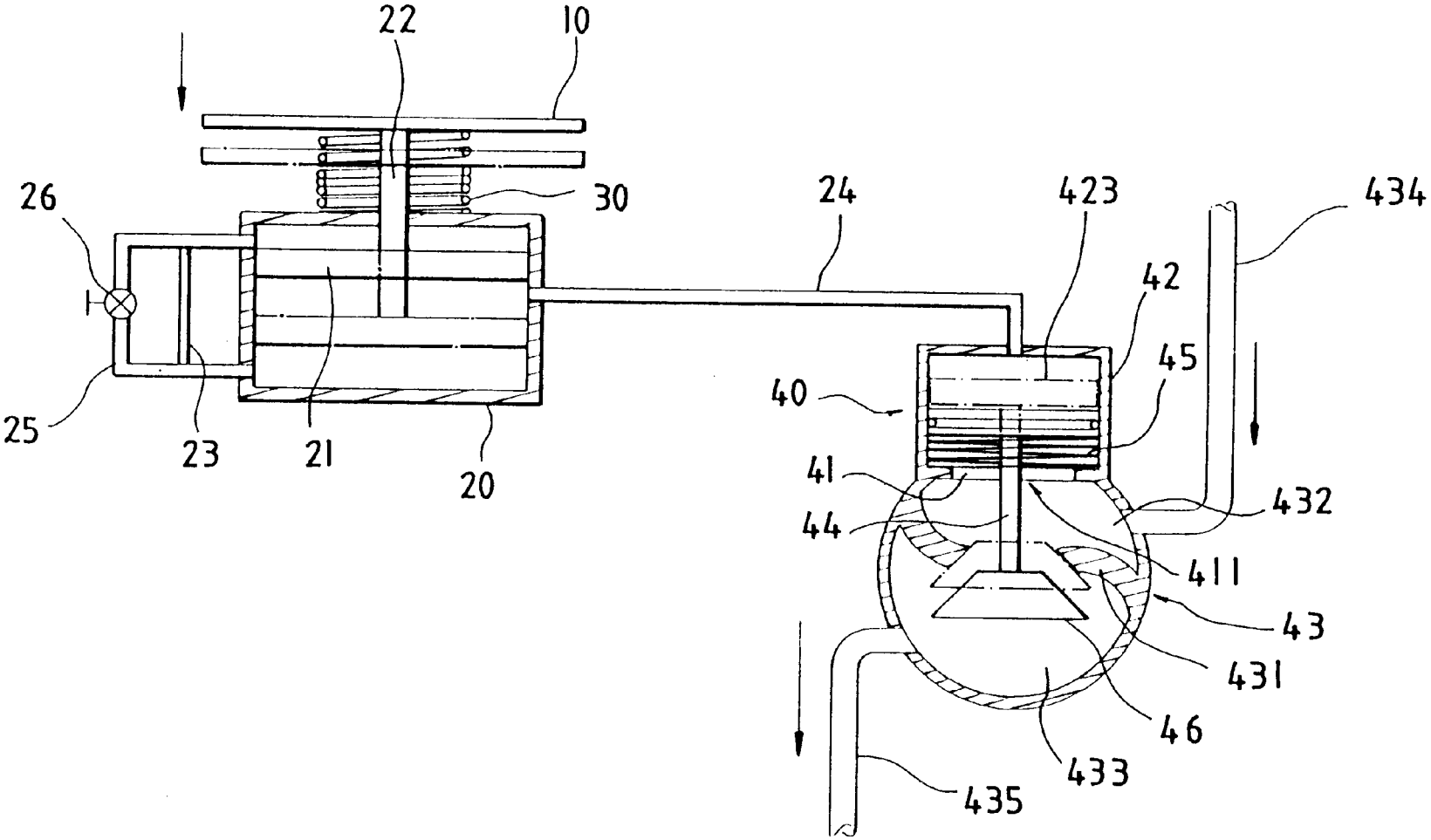
FIG. 3 is a sectional view of the present invention, showing the operation of the hydraulic drive urinal flushing system.
Figure 4:
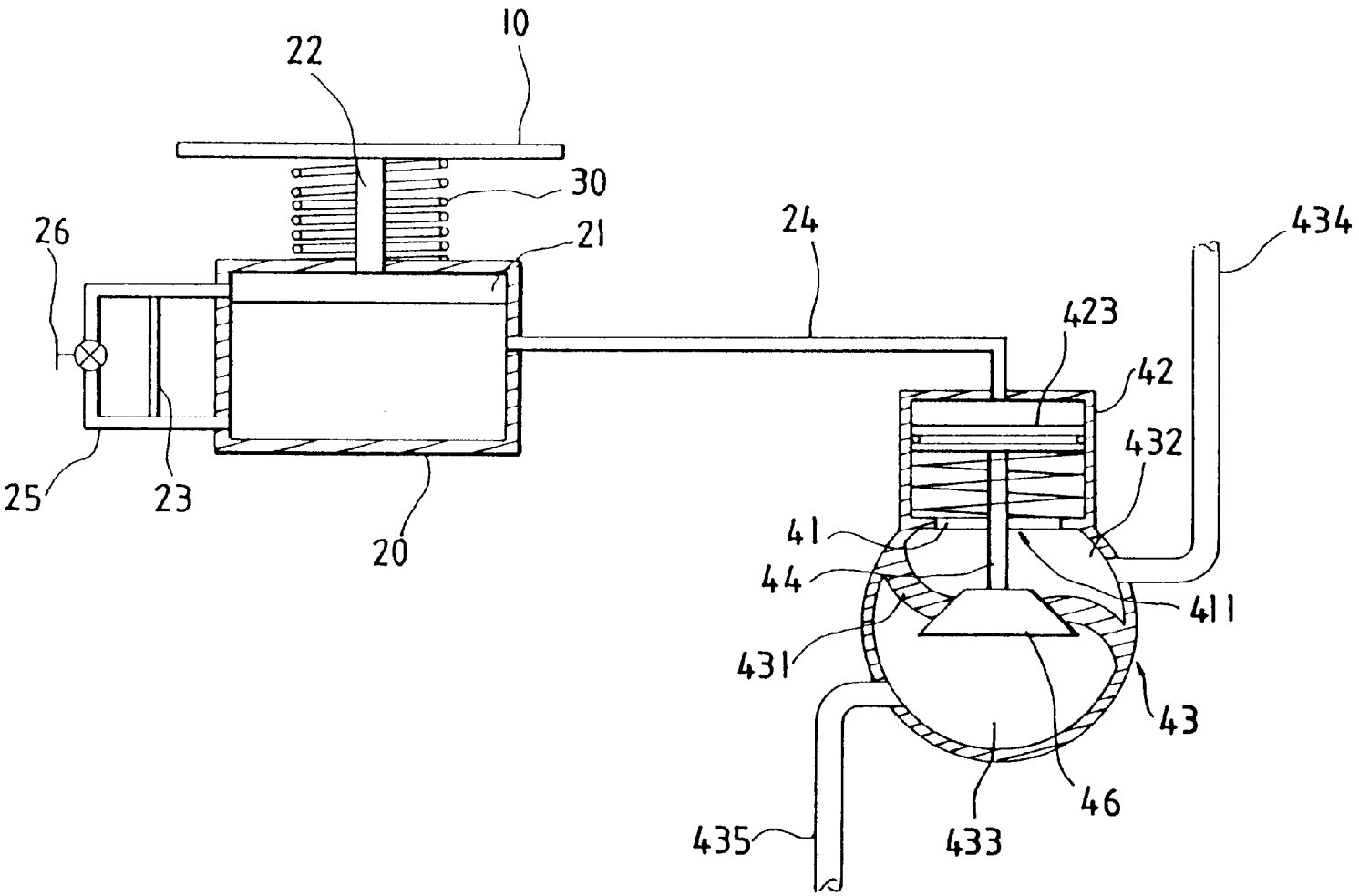
FIG. 4 is another sectional view of the present invention, showing the piston moved to the upper limit position, the water passage closed.

Referring to FIGS. 2, 3 and 4, a hydraulic drive urinal flushing system in accordance with the present invention is generally comprised of a weight sensor 10, a hydraulic cylinder 20, a spring member 30, and a valve 40.

The weight sensor 10 is, for example, a foot plate protruding from the floor in front of the urinal 50.

The hydraulic cylinder 20 is embedded in the floor beneath the weight sensor 10. The hydraulic cylinder 20 comprises a piston 21 longitudinally reciprocated on the inside, a piston rod 22 perpendicularly extended from the piston 21 to the outside of the hydraulic cylinder 20 and connected to the weight sensor 10. A return pipe 23 is connected in parallel to the hydraulic cylinder 20 at one side. The top and bottom ends of the return pipe 23 are respectively connected to the hydraulic cylinder 20 at different elevations. The hydraulic cylinder 20 has a hydraulic fluid delivery pipe 24 at one side opposite to the return pipe 23. The hydraulic fluid delivery pipe 24 is spaced from the top of the hydraulic cylinder 20 at a distance. The elevation of the hydraulic fluid delivery pipe 24 is lower than the top end of the return pipe 23.

The spring member 30 is mounted around the piston rod 22 and connected between the weight sensor 10 and the hydraulic cylinder 20.

The valve 40 is connected to one end of the hydraulic fluid delivery pipe 24 remote from the hydraulic cylinder 20. The valve 40 comprises a partition board 41, a first chamber 42 connected to the hydraulic fluid delivery pipe 24, a second chamber 43 separated from the first chamber 42 by the partition board 41, the second chamber 43 being divided by a partition wall 431 into an upper chamber 432 and a lower chamber 433, a baffle plate 423 fitting closely inside the first chamber 42 and moved up and down in the first chamber 42, a stem 44 perpendicularly and downwardly extended from the baffle plate 423 and inserted through a hole 411 on the partition board 41 into the second chamber 43, a spring member 45 mounted around the stem 44 and connected between the baffle plate 423 and the partition board 41, and a stem washer 46 fixedly mounted on the bottom end of the stem 44 inside the lower chamber 433 of the second chamber 43. The upper chamber 432 of the second chamber 43 is mounted with a water inlet pipe 434, which is connected to a water supply system. The lower chamber 433 is connected to the urinal 50 by a water outlet pipe 435. When the hydraulic fluid is forced out of the hydraulic cylinder 20 through the hydraulic fluid delivery pipe 24 into the first chamber 42, the baffle plate 423 is forced downwards to compress the spring member 45, and to lower the stem 44, thereby causing the stem washer 46 to be moved downwards with the stem 44. When the stem washer 46 is lowered, the passage between the upper chamber 432 and the lower chamber 433 is opened, enabling water to pass from the upper chamber 432 into the lower chamber 433, and then to pass from the lower chamber 433 through the water outlet pipe 435 to the urinal 50. On the contrary, when the hydraulic fluid is stopped from passing to the first chamber 42, the spring member 45 immediately pushes the baffle plate 423 upwards, thereby causing the stem washer 46 to be lifted with the stem 44 to close the passage between the upper chamber 432 and the lower chamber 433.

A guide pipe 25 is connected in parallel to the return pipe 23. A check valve 26 is mounted in the guide pipe 25. The check valve 26 allows the hydraulic fluid to circulate in one way from the hydraulic cylinder 20 through the top end of the guide pipe 25, then through the bottom end of the guide pipe 25, and then into the hydraulic cylinder 20 again. Therefore, when the piston 21 is lowered in the hydraulic cylinder 20, the hydraulic fluid is forced to flow out of the hydraulic cylinder 20 into the bottom end of the return pipe 23, then to flow out of the top end of the return pipe 23, and then to flow into the hydraulic cylinder 20 again. On the contrary, when the piston 21 is lifted in the hydraulic cylinder 20, the hydraulic fluid which is returned from the valve 40 through the hydraulic fluid delivery pipe 24 to the hydraulic cylinder 20 is forced to flow out of the hydraulic cylinder 20 into the top ends of the return pipe 23 and the guide pipe 25, then to flow out of the bottom ends of the return pipe 23 and the guide pipe 25, and then to flow into the hydraulic cylinder 20 again. Therefore, the weight sensor 10 is quickly returned to its former position when the hydraulic fluid is returned from the valve 40 into the hydraulic cylinder 20.

Referring to FIGS. 2, 3 and 4 again, when the user steps on the weight sensor 10 to discharge urine, the weight sensor 10 is forced downwards by the body weight of the user to compress the spring member 30 and to lower the piston rod 22 in the hydraulic cylinder 20, thereby causing the piston 21 to force the hydraulic fluid out of the hydraulic cylinder 20 through the hydraulic fluid delivery pipe 24 into the first chamber 42 of the valve 40. When the hydraulic fluid is forced into the first chamber 42 of the valve 40, the baffle plate 423 is lowered to compress the spring member 45 and to move the stem washer 46 downwards from the partition wall 431, thereby causing the passage between the upper chamber 432 and the lower chamber 433 to be opened. When the passage between the upper chamber 432 and the lower chamber 433 is opened, water is allowed to flow from the upper chamber 432 into the lower chamber 433, and then to flow from the lower chamber 433 to the urinal 50 via the water outlet pipe 435. When the piston 21 is moved to the elevation of the hydraulic fluid delivery pipe 24, the hydraulic fluid is stopped from flowing out of the hydraulic cylinder 20 into the hydraulic fluid delivery pipe 24. When the piston 22 is continuously moved downwards from the elevation of the hydraulic fluid delivery pipe 24, a negative pressure is produced in the hydraulic cylinder 20 above the piston 21, thereby causing the hydraulic fluid to be sucked from the hydraulic fluid delivery pipe 24 into the hydraulic cylinder 20. When the hydraulic fluid is returned from the hydraulic fluid delivery pipe 24 into the hydraulic cylinder 20, the spring member 45 immediately pushes the baffle plate 423 upwards to its former upper limit position. When the baffle plate 423 is lifted, the stem washer 46 is moved upwards with the stem 44 to close the passage between the upper chamber 432 and the lower chamber 433, and therefore water is stopped from passing into the lower chamber 433. Thus, a first stage of flushing operation is done.

Referring to FIGS. 3 and 4, when the user keeps standing on the weight sensor 10, the weight sensor 10 is continuously lowered to the lower limit position, the piston 21 is lowered in the hydraulic cylinder 20 below the elevation of the hydraulic fluid delivery pipe 24, and the hydraulic fluid is forced by the piston 21 to flow out of the hydraulic cylinder 20 into the bottom end of the return pipe 23, then to flow out of the top end of the return pipe 23 into the hydraulic cylinder 20 again, therefore the hydraulic fluid is accumulated in the hydraulic cylinder 20 above the piston 21. When the user steps off of the weight sensor 10, the spring member 30 immediately pushes the weight sensor 10 upwards to its former upper limit position, thereby causing the piston 21 to be lifted with the piston rod 22 and the weight sensor 10. When the piston 21 is lifted, the hydraulic fluid which is accumulated in the hydraulic cylinder 20 above the piston 21 is forced by the piston 21 out of the hydraulic cylinder 20 into the hydraulic fluid delivery pipe 24 and the first chamber 42 of the valve 40. When the hydraulic fluid is forced into the first chamber 42 of the valve 40, the baffle plate 423 is lowered in the first chamber 42 of the valve 40 to compress the spring member 45 and to lower the stem 44, thereby causing the stem washer 433 to open the passage between the upper chamber 432 and the lower chamber 433, and therefore water is allowed to pass from the upper chamber 432 into the lower chamber 433, and then to flow out of the lower chamber 433 through the water output pipe 435 to the urinal 50. When the piston 21 is lifted to the elevation of the hydraulic fluid delivery pipe 24, the hydraulic fluid fluid is stopped by the piston 21. When the piston 21 is moved upwards over the elevation of the hydraulic fluid delivery pipe 24, a negative pressure is produced in the hydraulic cylinder 20 below the piston 21, thereby causing the hydraulic fluid to be sucked from the hydraulic fluid delivery pipe 24 into the hydraulic cylinder 20 below the piston 21. At the same time, the baffle plate 423 is forced upwards to its former upper limit position by the spring member 45, and the stem washer 46 is lifted to stop the passage between the upper chamber 432 and the lower chamber 433, and therefore the flushing system is stopped from supplying water to the urinal 50. Thus, a second stage of flushing operation is done.

While only one embodiment of the present invention has been shown and described, it will be understood that various modifications and changes could be made thereunto without departing from the spirit and scope of the invention disclosed.

What the invention claimed is:

1. A hydraulic drive urinal flushing system comprising:

a weight sensor;

a hydraulic cylinder having a piston reciprocating therein, and a piston rod upwardly extended from said piston and connected to a bottom side of said weight sensor, said hydraulic cylinder holding a hydraulic fluid;

a return pipe connected in parallel to said hydraulic cylinder on the outside, said return pipe having a top end and a bottom end respectively connected to said hydraulic cylinder at different elevations;

spring means mounted around said piston rod and connected between said weight sensor and said hydraulic cylinder, said spring means imparting an upward pressure to said weight sensor;

a hydraulic fluid delivery pipe having a first and second end,said first end connected to said hydraulic cylinder at one side opposite to said return pipe at an elevation between the top end and bottom end of said return pipe; and a normally biased closed valve connected to the second end of said hydraulic fluid delivery pipe, said valve having a valve body responsive to said hydraulic fluid for controlling a supply of flushing water to a urinal;

wherein when a user steps on said weight sensor, said weight sensor is lowered to compress said spring means, and said piston is lowered with said weight sensor and said piston rod to force the hydraulic fluid out of said hydraulic cylinder through said hydraulic fluid delivery pipe into said valve, thereby causing said valve body of said valve to be opened, enabling water to pass to the urinal; the hydraulic fluid is returned from said valve through said hydraulic fluid delivery pipe to said hydraulic cylinder when said piston is lowered in said hydraulic cylinder below the elevation of said hydraulic fluid delivery pipe; said weight sensor is pushed upwards by said spring means to lift said piston in said hydraulic cylinder when the user steps off of said weight sensor, thereby causing the hydraulic fluid to be forced out of said hydraulic cylinder through said hydraulic fluid delivery pipe into said valve, and therefore said valve body of said valve is opened again to let water pass to the urinal.

2. The hydraulic drive urinal flushing system of claim 1 wherein said valve body comprises a partition board, a first chamber connected to said hydraulic fluid delivery pipe to receive the hydraulic fluid from said hydraulic cylinder, a second chamber separated from said first chamber by said partition board, said second chamber being divided by a partition wall into an upper chamber and a lower chamber, a baffle plate fitting closely inside said first chamber and moved up and down in said first chamber, a stem perpendicularly and downwardly extended from said baffle plate and inserted through a hole on said partition board into said second chamber, a spring member mounted around said stem and connected between said baffle plate and said partition board to push said baffle plate upwards from said partition board, a stem washer fixedly mounted on said stem inside said lower chamber of said second chamber, a water inlet pipe extended from said upper chamber of said second chamber to a water source for guiding water into said upper chamber of said second chamber, a water outlet pipe extended from said lower chamber of said second chamber to the urinal for guiding water from said second chamber to the urinal.

3. The hydraulic drive urinal flushing system of claim 1 wherein said weight sensor is a foot plate.

* * * * *